US010934847B2

(12) United States Patent
Danno et al.

(10) Patent No.: US 10,934,847 B2
(45) Date of Patent: Mar. 2, 2021

(54) STEAM TURBINE ROTOR BLADE, STEAM TURBINE, AND METHOD FOR MANUFACTURING STEAM TURBINE ROTOR BLADE

(71) Applicant: Mitsubishi Hitachi Power Systems, Ltd., Yokohama (JP)

(72) Inventors: Shohei Danno, Yokohama (JP); Takashi Maruyama, Yokohama (JP); Keiichiro Miyajima, Yokohama (JP)

(73) Assignee: MITSUBISHI POWER, LTD., Yokohama (JP)

( * ) Notice: Subject to any disclaimer, the term of this patent is extended or adjusted under 35 U.S.C. 154(b) by 219 days.

(21) Appl. No.: 16/086,776

(22) PCT Filed: Apr. 14, 2017

(86) PCT No.: PCT/JP2017/015325
§ 371 (c)(1),
(2) Date: Sep. 20, 2018

(87) PCT Pub. No.: WO2017/179711
PCT Pub. Date: Oct. 19, 2017

(65) Prior Publication Data

US 2019/0101000 A1 Apr. 4, 2019

(30) Foreign Application Priority Data

Apr. 14, 2016 (JP) ..... JP2016-080994
Oct. 28, 2016 (JP) ..... JP2016-212034

(51) Int. Cl.
*F01D 5/14* (2006.01)
*F01D 5/22* (2006.01)
(Continued)

(52) U.S. Cl.
CPC ..... *F01D 5/14* (2013.01); *F01D 5/22* (2013.01); *F01D 5/28* (2013.01); *F01D 25/00* (2013.01);
(Continued)

(58) Field of Classification Search
CPC ..... F01D 5/14; F01D 5/22; F01D 5/28; F01D 25/00; F01D 25/16; F01D 25/183; F05D 2220/31; F05D 2240/303
See application file for complete search history.

(56) References Cited

U.S. PATENT DOCUMENTS 3,561,886 A 2/1971 Kreischer, Jr. et al.
5,829,955 A 11/1998 Saito et al.
(Continued)

FOREIGN PATENT DOCUMENTS

EP 1609951 A1 12/2005
EP 1911935 A2 4/2008
(Continued)

OTHER PUBLICATIONS

International Search Report dated Jul. 4, 2017, issued in counterpart application No. PCT/JP2017/015325 , with English translation. (4 pages).
(Continued)

*Primary Examiner* — Michael Lebentritt
*Assistant Examiner* — Jesse M Prager
(74) *Attorney, Agent, or Firm* — Westerman, Hattori, Daniels & Adrian, LLP

(57) ABSTRACT

A steam turbine rotor blade includes a protrusion portion (7) which is provided on a tip end portion of a blade body (61), on which a leading edge portion (61*a*) is formed, in a blade height direction and protrudes from a suction-side surface (612) toward the leading edge portion (61*a*) side, and a transition-region seal member which is provided so as to
(Continued)

cover at least a portion of a base end-side surface of the protrusion portion (7) and a leading edge-side transition region, which faces the leading edge portion (61*a*) side, of a connection portion between the protrusion portion (7) and the suction-side surface (612), the transition-region seal member being formed of a material having a hardness higher than that of the blade body (61).

7 Claims, 8 Drawing Sheets

(51) Int. Cl.
*F01D 5/28* (2006.01)
*F01D 25/00* (2006.01)
*F01D 25/16* (2006.01)
*F01D 25/18* (2006.01)

(52) U.S. Cl.
CPC ..... *F01D 25/16* (2013.01); *F01D 25/183* (2013.01); *F05D 2220/31* (2013.01); *F05D 2240/303* (2013.01)

(56) References Cited

U.S. PATENT DOCUMENTS

| | | | | |
|---|---|---|---|---|
| 6,127,044 | A | 10/2000 | Yamamoto et al. | |
| 2006/0118215 | A1* | 6/2006 | Hirakawa | C21D 6/005 148/607 |
| 2009/0014561 | A1 | 1/2009 | McMasters et al. | |
| 2011/0268574 | A1 | 11/2011 | Masserey et al. | |
| 2013/0101425 | A1 | 4/2013 | Arai et al. | |
| 2013/0129435 | A1 | 5/2013 | Ortlund et al. | |
| 2015/0369058 | A1 | 12/2015 | Negri et al. | |
| 2017/0321303 | A1* | 11/2017 | Fribourg | C22C 14/00 |

FOREIGN PATENT DOCUMENTS

| | | | | | |
|---|---|---|---|---|---|
| JP | 54106708 | A | * | 8/1979 | |
| JP | S56-129501 | U | | 10/1981 | |
| JP | 58138204 | A | * | 8/1983 | F01D 5/28 |
| JP | 60173301 | A | * | 9/1985 | F01D 5/28 |
| JP | S61-201801 | A | | 9/1986 | |
| JP | 63-097802 | A | | 4/1988 | |
| JP | H9-209704 | A | | 8/1997 | |
| JP | 2009-115443 | A | | 5/2009 | |
| JP | 2012-504203 | A | | 2/2012 | |
| JP | 2012-077355 | A | | 4/2012 | |
| JP | 2013-87712 | A | | 5/2013 | |
| JP | 2013-107199 | A | | 6/2013 | |
| JP | 2014-224488 | A | | 12/2014 | |
| WO | 97/10066 | A1 | | 3/1997 | |

OTHER PUBLICATIONS

Written Opinion dated Jul. 4, 2017, issued in counterpart application No. PCT/JP2017/015325 , with English translation. (8 pages).

* cited by examiner

STEAM TURBINE ROTOR BLADE, STEAM TURBINE, AND METHOD FOR MANUFACTURING STEAM TURBINE ROTOR BLADE

TECHNICAL FIELD

The present invention relates to a steam turbine rotor blade, a steam turbine, and a method for manufacturing a steam turbine rotor blade.

Priority is claimed on Japanese Patent Application Nos. 2016-080994, filed on Apr. 14, 2016 and 2016-212034, filed on Oct. 28, 2016, the contents of which are incorporated herein by reference.

BACKGROUND

A steam turbine is used to drive a machine or the like and includes a rotor that is rotatably supported and a casing which covers the rotor. Steam serving as a working fluid is supplied to the rotor, and thus, the steam turbine is rotationally driven. In the steam turbine, rotor blades are provided in the rotor, and stator vanes are provided in the casing which covers the rotor. A plurality of stages of rotor blades and a plurality of stages of stator vanes are alternately disposed in a steam flow path of the steam turbine. As steam flows through the steam flow path, a flow of the steam is rectified by the stator vanes, and the rotor is rotationally driven via the rotor blades.

In the steam turbine, water droplets (drain) are generated in the steam flowing through the steam flow path. If the steam containing the water droplets flows through the steam flow path and the water droplets collide with the rotor blade rotating at a high speed, erosion in which a blade surface is eroded occurs.

Accordingly, a protective member for preventing the erosion is provided on a leading edge portion of the rotor blade in which the erosion easily occurs. For example, Patent Document 1 discloses a rotor blade having an erosion shield formed of a stellite plate as a protection member.

CITATION LIST

Patent Literature

[Patent Document 1] Japanese Unexamined Patent Application, First Publication No. 2013-87712

SUMMARY OF INVENTION

Technical Problem

In recent years, a rotor blade has been increasing in length and size with an increase in size of the steam turbine. Meanwhile, in order to decrease the weight of the rotor blade, the thickness of a tip end portion of the rotor blade is decreased. In such a rotor blade, in order to adjust a gap between the rotor blade and another rotor blade adjacent in a circumferential direction, a structure protruding in the circumferential direction from a blade surface may be provided on the tip end portion of the rotor blade.

In the long, large rotor blade, collision speeds of the water droplets increase toward the tip end. Accordingly, in the rotor blade that is increased in length and size and decreased in thickness at the tip end portion, influences of thinning due to erosion in the tip end portion are greater than those in other portions. Particularly, in a rotor blade in which a protrusion portion is provided on a tip end portion having a small thickness and thus the tip end portion has a complicated shape, the influences are greater. With respect to such a rotor blade, there is a desire to particularly suppress the influences of the erosion in the tip end portion.

The present invention provides a steam turbine rotor blade, a steam turbine, and a method for manufacturing a steam turbine rotor blade capable of suppressing the influences of erosion in the tip end portion on which the protrusion portion is formed.

Solution to Problem

According to a first aspect of the present invention, there is provided a steam turbine rotor blade including a blade body which includes a pressure-side surface and a suction-side surface extending in a blade height direction and a leading edge portion which is formed by the pressure-side surface and the suction-side surface and extends in the blade height direction; a protrusion portion which is provided on a tip end portion of the blade body in the blade height direction and protrudes from the suction-side surface toward the leading edge portion side; and a transition-region seal member which is provided so as to cover at least a portion of a base end-side surface of the protrusion portion facing a base end side opposite to a tip end in the blade height direction, and a leading edge-side transition region, facing the leading edge portion side, of a connection portion between the protrusion portion and the suction-side surface, the transition-region seal member being formed of a material having a hardness higher than that of the blade body. A first recessed portion which is recessed from the suction-side surface is formed in the leading edge-side transition region, and the transition-region seal member includes a front-side seal portion which is disposed in the first recessed portion such that a surface of the front-side seal portion is flush with a surface of the blade body, and a base end-side seal portion which is integrally formed with the front-side seal portion and is disposed on the base end-side surface such that a surface of the base end-side seal portion protrudes from the base end-side surface.

According to this configuration, the base end-side seal portion is disposed in the state of being placed on the base end-side surface such that the surface of the base end-side seal portion protrudes from the base end-side surface. Accordingly, it is not necessary to form a recessed portion for disposing the transition-region seal member in the base end-side surface. Therefore, it is possible to suppress a cost or a time for processing the base end-side surface that extends at an angle largely different from that of the suction-side surface. Accordingly, it is possible to suppress the influences of the erosion on the tip end portion, on which the protrusion portion is formed, by the transition-region seal member that is manufactured while suppressing the cost. In addition, that it is not necessary to form the recessed portion for disposing the transition-region seal member in the base end-side surface of the protrusion portion is advantageous in securing the strength of the protrusion portion that comes into contact with other adjacent blades and receives a force. Moreover, it is possible to dispose the erosion shield simply by forming the recessed portion corresponding to the front-side seal portion, even for a type of a blade having no erosion shield disposed thereon, and thus, it is possible to simply improve the erosion resistance of the existing blade on which the erosion shield is not mounted.

In a steam turbine rotor blade according to a second aspect of the present invention, in the first aspect, the transition-region seal member may cover a boundary line at which a leading edge-side surface of the protrusion portion facing a leading edge side and the base end-side surface of the protrusion portion are connected to each other, over a predetermined length from a connection point between the boundary line and the suction-side surface, and in a case where a length of the boundary line from the connection point to a tip end portion of the protrusion portion is defined as L, the predetermined length may be a length of 0.9 L or less from the connection point.

According to this configuration, the tip end of the boundary line is partially not covered, and thus, it is not necessary to form the transition-region seal member having high precision corresponding to a narrow region of the tip end portion of the protrusion portion. In addition, the boundary line is covered from the connection point, and thus, it is possible to reliably protect a portion in which erosion easily occurs. Accordingly, it is possible to suppress the manufacturing cost of the transition-region seal member while suppressing the influences of the erosion.

In a steam turbine rotor blade according to a third aspect of the present invention, in the first or second aspect, the steam turbine rotor blade may further include a leading-edge seal member which is provided so as to cover the leading edge portion and is formed of a material having a hardness higher than that of the blade body. The blade body may include a second recessed portion which is recessed from the surface of the blade body at the leading edge portion, and the leading-edge seal member may be disposed in the second recessed portion such that a surface of the leading-edge seal member is flush with the surface of the blade body.

According to this configuration, it is possible to suppress occurrence of erosion in the leading edge portion. Moreover, in the leading edge portion, the leading-edge seal member does not protrude from the surface of the blade body, and thus, it is possible to prevent the flow of the steam in the flow path from being hindered.

In a steam turbine rotor blade according to a fourth aspect of the present invention, in the third aspect, the transition-region seal member and the leading-edge seal member may be integrally formed with each other, and the first recessed portion and the second recessed portion may be formed to be connected to each other and to have the same depth.

According to this configuration, the transition-region seal member and the leading-edge seal member can be joined to the blade body in a few steps. In addition, the first recessed portion and the second recessed portion have the same depth, and thus, the transition-region seal member and the leading-edge seal member can be formed of plate materials having the same thickness. Accordingly, it is possible to suppress manufacturing costs of the transition-region seal member and the leading-edge seal member.

According to a fifth aspect of the present invention, there is provided a steam turbine including: a rotor which includes the steam turbine rotor blade according to any one of the first to fourth aspects; and a casing which covers the rotor.

According to this configuration, influences of erosion in the steam turbine rotor blade can be suppressed, and it is possible to lengthen a lifespan of the steam turbine rotor blade.

According to a sixth aspect of the present invention, there is provided a method for manufacturing a steam turbine rotor blade, including a blade body forming step of integrally forming a blade body which includes a pressure-side surface and a suction-side surface extending in a blade height direction and a leading edge portion which is formed by the pressure-side surface and the suction-side surface and extends in the blade height direction, and a protrusion portion which is provided on a tip end portion of the blade body in the blade height direction and protrudes from the suction-side surface toward the leading edge portion side; a seal member forming step of forming, by metal injection molding, a transition-region seal member which is shaped so as to cover at least a portion of a base end-side surface of the protrusion portion facing a base end side opposite to a tip end in the blade height direction, and a leading edge-side transition region, facing the leading edge portion side, of a connection portion between the protrusion portion and the suction-side surface, the transition-region seal member being formed of a material having a hardness higher than that of the blade body; and a joining step of joining the transition-region seal member to at least a portion of the base end-side surface and the leading edge-side transition region. In the blade body forming step, a first recessed portion which is recessed from the suction-side surface is formed in the leading edge-side transition region, and the transition-region seal member includes a front-side seal portion which is capable of being disposed in the first recessed portion such that a surface of the front-side seal portion is flush with a surface of the blade body, and a base end-side seal portion which is integrally formed with the front-side seal portion and is capable of being disposed on the base end-side surface such that a surface of the base end-side seal portion protrudes from the base end-side surface.

In a method for manufacturing a steam turbine rotor blade in a seventh aspect of the present invention, in the sixth aspect, in the joining step, the transition-region seal member may be brazed to the blade body and the protrusion portion.

Advantageous Effects of Invention

According to the present invention, it is possible to suppress the influences of erosion in the tip end portion on which the protrusion portion is formed.

DESCRIPTION OF EMBODIMENTS

Hereinafter, an embodiment according to the present invention will be described with reference to the drawings.

Figure 1:
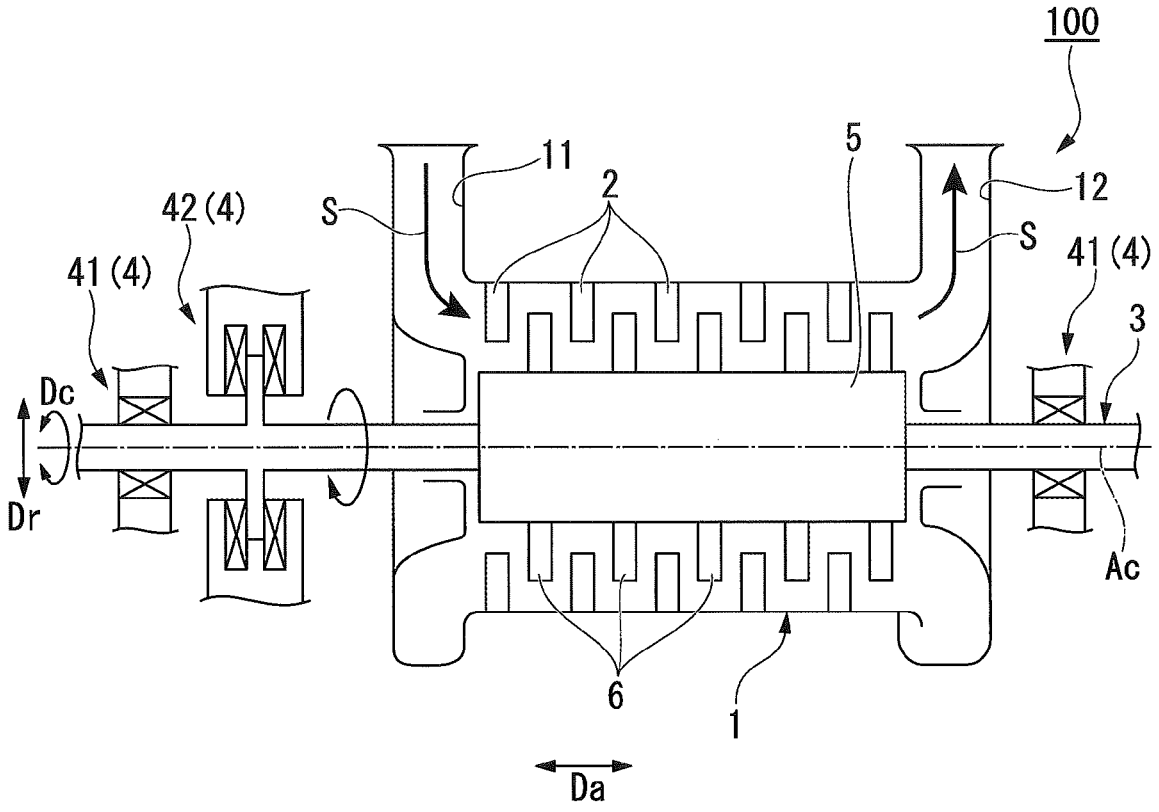
FIG. 1 is a schematic view showing a configuration of a steam turbine in an embodiment of the present invention.

A steam turbine 100 is a rotary machine that extracts energy of steam S as rotational power. As shown in FIG. 1, the steam turbine 100 of the present embodiment includes a casing 1, stator vanes 2, a rotor 3, and bearing portions 4.

Hereinafter, a direction in which an axis Ac of the rotor 3 extends is referred to as an axial direction Da, a circumferential direction with respect to the axis Ac is simply referred to as a circumferential direction Dc, and a radial direction with respect to the axis Ac is simply referred to as a radial direction Dr. In addition, one side in the axial direction Da is referred to as an upstream side, and the other side in the axial direction Da is referred to as a downstream side.

An internal space of the casing 1 is airtightly sealed, and a flow path of the steam S is formed inside the casing 1. The casing 1 covers the rotor 3 from an outside in the radial direction Dr. A steam inlet 11 which introduces the steam S into the casing 1 is formed on an upstream-side portion of the casing 1. A steam outlet 12 which discharges the steam S which has passed through the casing 1 to the outside is formed on a downstream-side portion of the casing 1.

A plurality of stator vanes 2 are provided on a surface of the casing 1 facing the inside, to be aligned in the circumferential direction Dc of the rotor 3. The stator vanes 2 are disposed to be separated from the rotor 3 in the radial direction Dr. The stator vanes 2 are disposed to be separated from rotor blades 6, to be described later, in the axial direction Da.

The rotor 3 rotates about the axis Ac. The rotor 3 includes a rotor body 5 and rotor blades (steam turbine rotor blades) 6.

The rotor body 5 extends in the axial direction Da to penetrate the casing 1. An intermediate portion of the rotor body 5 on which the rotor blades 6 are provided is accommodated inside the casing 1. Both end portions of the rotor body 5 protrude toward the outside of the casing 1. Both end portions of the rotor body 5 are rotatably supported by the bearing portions 4.

The bearing portions 4 rotatably support the rotor 3 around the axis Ac. The bearing portions 4 include journal bearings 41 which are respectively provided on both end portions of the rotor body 5 and a thrust bearing 42 which is provided on one end side of the rotor body 5.

Figure 2:
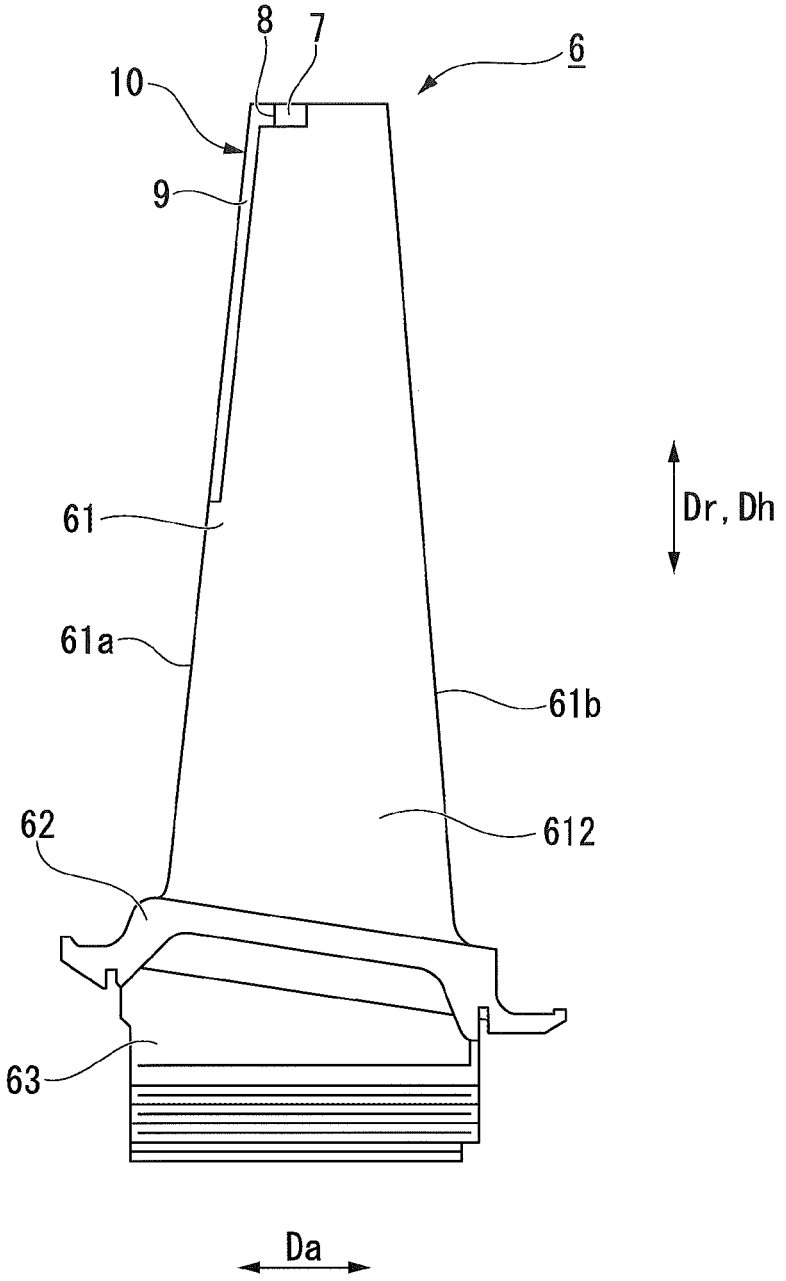
FIG. 2 is a side view of a steam turbine rotor blade in the embodiment of the present invention.

A plurality of rotor blades 6 are disposed to be aligned on the rotor body 5 in the circumferential direction Dc. The plurality of rotor blades 6 are annularly disposed on an outer peripheral surface of the rotor body 5. The rotor blades 6 receive the steam S flowing in the axial direction Da of the rotor 3 and rotates the rotor body 5 around the axis Ac. As shown in FIG. 2, each of the rotor blades 6 of the present embodiment includes a blade body 61, a platform 62, a blade root portion 63, a protrusion portion 7, and a seal member 10.

The blade body 61 extends in the radial direction Dr. In the rotor blade 6 of the present embodiment, a direction in which the blade body 61 extends is referred to as a blade height direction Dh. That is, the blade height direction Dh in the present embodiment is the radial direction Dr. The blade body 61 has an airfoil shape. The blade body 61 is formed such that a length of the blade body 61 in the axial direction Da decreases and a thickness of the blade body 61 in the circumferential direction Dc decreases, from a base end of the blade body 61 in the blade height direction Dh toward a tip end thereof in the blade height direction Dh. That is, the blade body 61 is formed to be thinned from the base end opposite to the tip end toward the tip end in the blade height direction Dh. In the present embodiment, the tip end of the blade body 61 in the blade height direction Dh is one end portion of the blade body 61 in the blade height direction Dh. The blade body 61 includes a pressure-side surface 611 and a suction-side surface 612 extending in the blade height direction Dh, as surfaces facing in the circumferential direction Dc. The suction-side surface 612 is a surface that faces the downstream side and protrudes. The pressure-side surface 611 is a surface that faces the upstream side and is recessed. In the blade body 61, a leading edge portion 61*a* and a trailing edge portion 61*b* extending in the blade height direction Dh are formed by the pressure-side surface 611 and the suction-side surface 612.

In the present embodiment, the base end side of the blade body 61 in the blade height direction Dh is the inside in the radial direction Dr. The tip end side of the blade body 61 in the blade height direction Dh is the outside in the radial direction Dr. That is, the base end of the blade body 61 is the side opposite to the tip end of the blade body 61 in the blade height direction Dh.

The leading edge portion 61*a* is an upstream-side end portion of the blade body 61. The leading edge portion 61*a* is a portion in which the pressure-side surface 611 and the suction-side surface 612 are connected to each other in a cross section orthogonal to the blade height direction Dh.

The trailing edge portion 61*b* is a downstream-side end portion of the blade body 61. The trailing edge portion 61*b* is a portion in which the pressure-side surface 611 and the suction-side surface 612 are connected to each other on a side opposite to the leading edge portion 61*a* in the axial direction Da in the cross section orthogonal to the blade height direction Dh.

The platform 62 is provided on the base end portion of the blade body 61 in the blade height direction Dh. That is, the platform 62 is provided on the inside of the blade body 61 in the radial direction Dr. In the present embodiment, the base end of the blade body 61 in the blade height direction Dh is the other end portion of the blade body 61 in the blade height direction Dh. The platform 62 is a plate-shaped member that is connected to the base end portion of the blade body 61 in the blade height direction Dh and spreads in a direction having a component orthogonal to the blade height direction Dh.

The blade root portion 63 extends from the platform 62 to a side opposite to the blade body 61 in the blade height direction Dh. The blade root portion 63 is provided on the inside of the platform 62 in the radial direction Dr. The blade root portion 63 is fitted in the rotor body 5.

Figure 3:
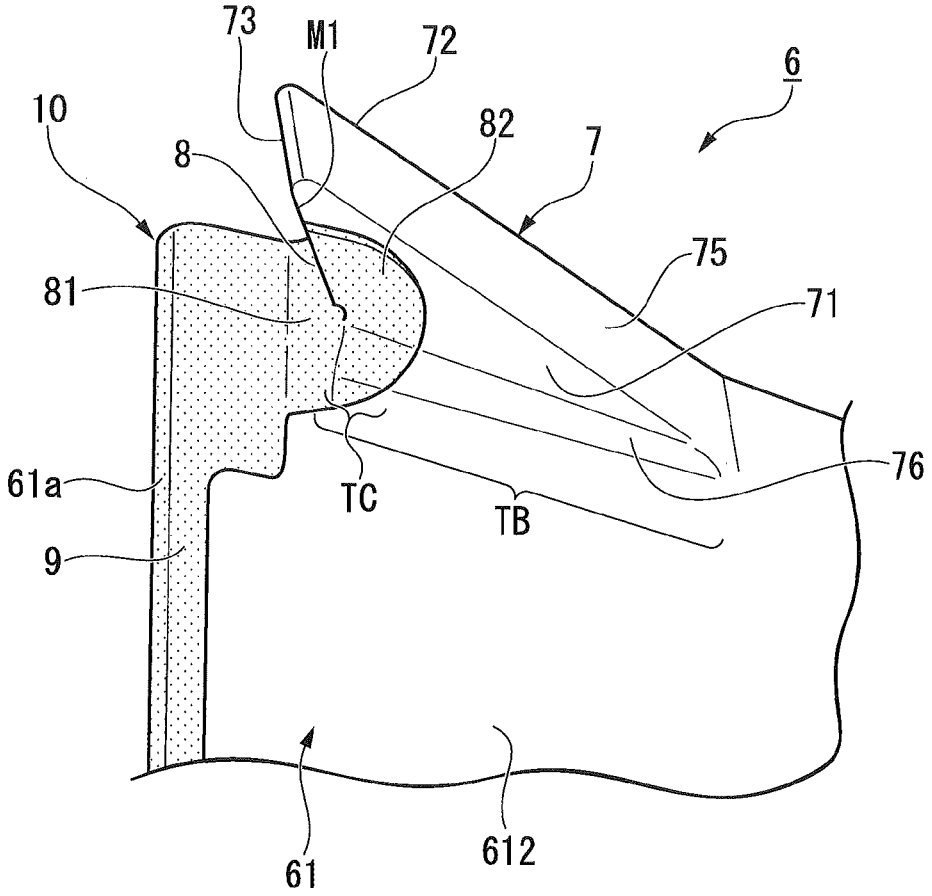
FIG. 3 is a perspective view showing a tip end portion of the steam turbine rotor blade in the embodiment of the present invention from a radially inner side.
Figure 4:
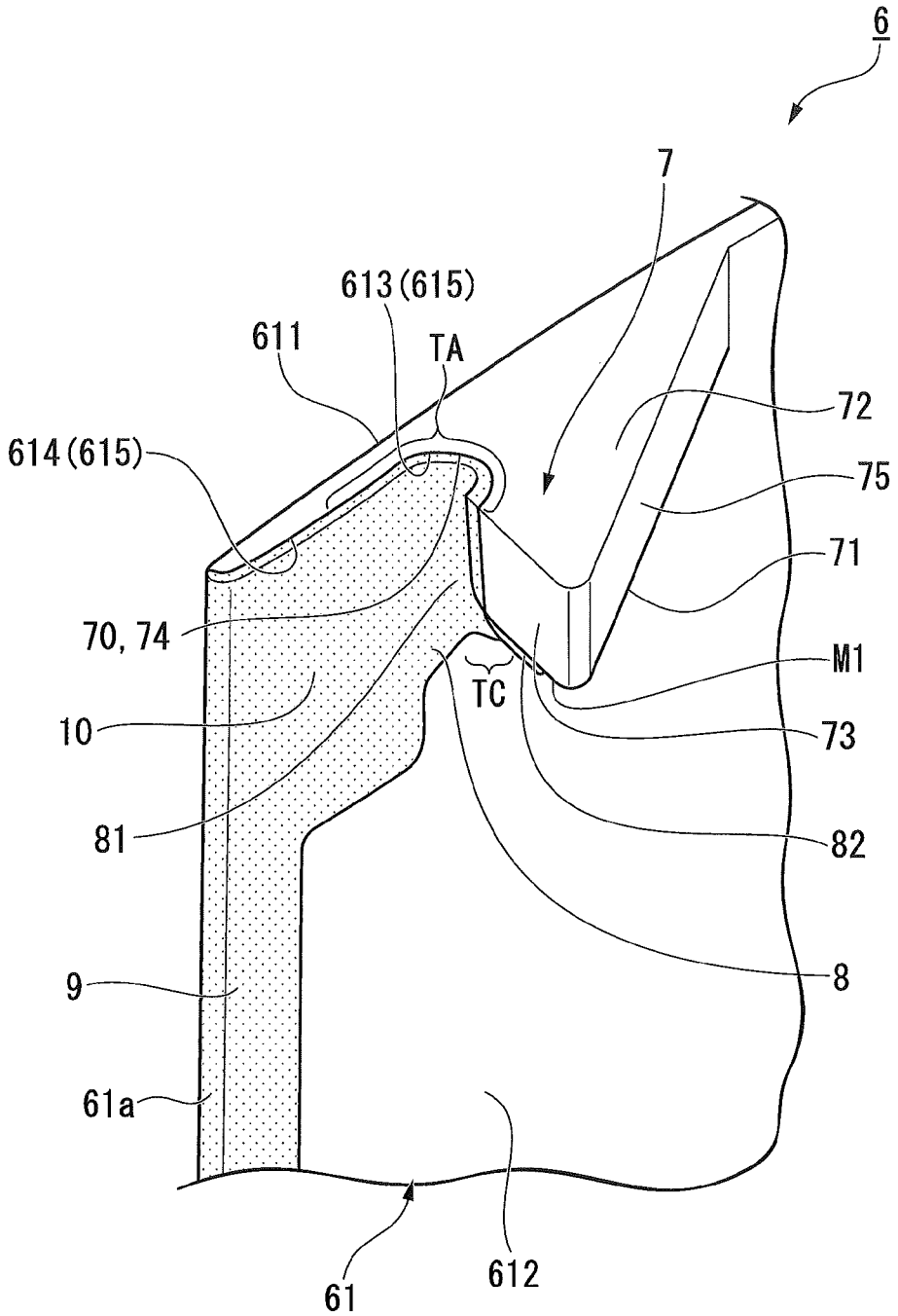
FIG. 4 is a perspective view showing the tip end portion of the steam turbine rotor blade in the embodiment of the present invention from a radially outer side.

The protrusion portion 7 is provided on a tip end portion of the blade body 61 in the blade height direction Dh. The protrusion portion 7 protrudes from the suction-side surface 612 toward the leading edge portion 61*a* side. The protrusion portion 7 is not an end plate which is provided on the tip end of the blade body 61 in the blade height direction Dh, but instead the protrusion portion 7 partially protrudes from the suction-side surface 612. That is, the protrusion portion 7 is not provided on the entire region of the tip end portion of the blade body 61, but instead forms a portion of the tip end portion of the blade body 61. As shown in FIGS. 3 and 4, the protrusion portion 7 is formed at a position away from the leading edge portion 61*a*. When the protrusion portion 7 is viewed in the blade height direction Dh, the protrusion portion 7 is formed to be gradually thinned as it approaches the leading edge portion 61*a* away from the suction-side surface 612. In the protrusion portion 7 of the present embodiment, a groove portion 70 that is recessed toward the trailing edge portion 61*b* side is formed in a leading edge-side transition region TA. The protrusion portion 7 is formed at such a position that a root thereof on the leading edge portion 61*a* side is positioned at a position of 0.15 Y or less from the leading edge portion 61*a* with respect to a blade chord length Y which is a length from the leading edge portion 61*a* to the trailing edge portion 61*b* of the blade body 61. More preferably, the position of the root of the protrusion portion 7 is 0.1 Y or less from the leading edge portion 61*a*. The position of the root of the protrusion portion 7 is a position at which, when extended, a third surface 73 to be described later is connected to the suction-side surface 612 as viewed from the tip end side.

Here, the leading edge-side transition region TA is a region, which faces not the trailing edge portion 61*b* side but the leading edge portion 61*a* side, of a connection portion between the protrusion portion 7 and the suction-side surface 612. The leading edge-side transition region TA of the present embodiment is the groove portion 70 and a portion of the suction-side surface 612 continuous to the groove portion 70. Accordingly, the connection portion between the protrusion portion 7 and the suction-side surface 612 is recessed such that the side close to the leading edge portion 61*a* of the connection portion is cut out by the groove portion 70 when viewed in the blade height direction Dh.

In the present embodiment, a region, which faces the base end side that is opposite to the tip end in the blade height direction Dh, of the connection portion between the protrusion portion 7 and the suction-side surface 612 is referred to as a base end-side transition region TB. That is, the base end-side transition region TB is a region, which is formed on the base end side in the blade height direction Dh, of the region in which the protrusion portion 7 and the suction-side surface 612 are connected to each other. The base end-side transition region TB is formed on the side close to the platform 62 (the inside in the radial direction Dr) with respect to the protrusion portion 7 in the blade height direction Dh. The base end-side transition region TB of the present embodiment is formed by a portion of a surface of the protrusion portion 7 facing the platform 62 side and a portion of the suction-side surface 612.

Moreover, in the present embodiment, a region, which is connected to the leading edge-side transition region TA, of the base end-side transition region TB is referred to as an intersection region TC. The intersection region TC is a region, which is formed on the side close to the leading edge portion 61*a*, of the base end-side transition region TB. The intersection region TC is a region of the protrusion portion 7 that is connected to the suction-side surface 612 on the base end side in the blade height direction Dh and on the leading edge portion 61*a* side. The intersection region TC faces the inside of the groove portion 70 in the radial direction Dr.

In the protrusion portion 7, a first surface (base end-side surface) 71 which faces the platform 62 side, a second surface 72 which faces a side opposite to the first surface 71, the third surface (leading edge-side surface) 73 which face the upstream side, a fourth surface 74 which connects the suction-side surface 612 and the third surface 73 to each other, a fifth surface 75 which faces the downstream side, and a connection surface 76 which connects the first surface 71 and the suction-side surface 612 to each other are formed.

The first surface 71 faces the base end side. The first surface 71 faces the inside in the radial direction Dr. The first surface 71 is a flat surface which spreads in a direction having a component perpendicular to the blade height direction Dh. That is, the first surface 71 spreads in a direction having a component perpendicular to the suction-side surface 612. In the present embodiment, the first surface 71 has a triangular shape.

The second surface 72 faces the outside in the radial direction Dr. The second surface 72 is a flat surface which spreads in the direction having the component perpendicular to the blade height direction Dh. The second surface 72 is formed to be parallel to the first surface 71. The second surface 72 is formed to be flush with a tip end surface of the blade body 61 in the blade height direction Dh. In the present embodiment, the second surface 72 is formed in a triangular shape having the same size as the first surface 71.

The third surface 73 faces the leading edge portion 61*a* side. The third surface 73 is connected perpendicularly to the first surface 71 and the second surface 72. The third surface 73 is a flat surface which spreads in a direction having a component inclined to the upstream side in the axial direction Da and in the blade height direction Dh. In the present embodiment, the third surface 73 has a rectangular shape.

The fourth surface 74 faces the leading edge portion 61*a* side. The fourth surface 74 is a surface that forms the groove portion 70. The fourth surface 74 is a concave curved surface that is recessed from the leading edge portion 61*a* side toward the trailing edge portion 61*b* side. The fourth surface 74 connects the suction-side surface 612 and the third surface 73 to each other. The fourth surface 74 is connected perpendicularly to the first surface 71 and the second surface 72. The fourth surface 74 constitutes the leading edge-side transition region TA together with a portion of the suction-side surface 612. The fourth surface 74 of the present embodiment constitutes the intersection region TC together with a portion of the suction-side surface 612, a portion of the first surface 71, and the connection surface 76.

The fifth surface 75 is connected to the suction-side surface 612 and faces the trailing edge portion 61*b* side. The fifth surface 75 is connected perpendicularly to the first surface 71 and the second surface 72. The fifth surface 75 is connected to the third surface 73 to have an acute angle with respect to the third surface 73. The fifth surface 75 is a flat surface that spreads in a direction having a component inclined to the downstream side in the axial direction Da and in the blade height direction Dh. In the present embodiment, the fifth surface 75 has a rectangular shape.

The connection surface 76 is a curved surface that connects the blade body 61 and the protrusion portion 7 to each other. The connection surface 76 smoothly connects to each other the suction-side surface 612 and the first surface 71 which are surfaces disposed to be approximately perpendicular to each other. The connection surface 76 has a curved surface that is continuous to the suction-side surface 612 and the first surface 71. In the connection surface 76, a curvature radius of the curved surface is discontinuously changed with respect to the suction-side surface 612. That is, even in a case where the suction-side surface 612 is formed by a complicated three-dimensional curved surface, the connection surface 76 is connected to the first surface 71 with the curvature radius thereof largely changed from the end portion of the suction-side surface 612. The connection surface 76 forms the base end-side transition region TB together with a portion of the suction-side surface 612 and a portion of the first surface 71.

A first recessed portion 613 that is recessed from the suction-side surface 612, the third surface 73, and the fourth surface 74 is formed in the leading edge-side transition region TA. The first recessed portion 613 is recessed to have the same depth over the entire region.

The blade body 61 has a second recessed portion 614 that is recessed from the surface at the leading edge portion 61*a*. The second recessed portion 614 is recessed to have the same depth over the entire region. In the present embodiment, the second recessed portion 614 forms a dent portion 615 integrally with the first recessed portion 613. Accordingly, the first recessed portion 613 and the second recessed portion 614 are formed to be connected to each other and to have the same depth. The dent portion 615 is recessed from the suction-side surface 612 and the protrusion portion 7 to have approximately the same depth as the thickness of the seal member 10.

The seal member 10 is provided so as to cover the leading edge-side transition region TA, the leading edge portion 61*a*, and at least a portion of the first surface 71. The seal member 10 is formed to have the same thickness from the base end-side transition region TB to the leading edge portion 61*a* via the leading edge-side transition region TA. The seal member 10 is formed of a material having a hardness higher than that of the blade body 61. The seal member 10 is formed by molding stellite by metal injection molding. The seal member 10 is fixed to the dent portion 615 of the blade body 61 by brazing using a silver solder. That is, the dent portion 615 is recessed from the suction-side surface 612 to have the depth that is approximately the same as the thickness of the seal member 10 in accordance with the shape of the seal member 10. The seal member 10 includes a first seal member (transition-region seal member) 8 and a second seal member (leading-edge seal member) 9. The seal member 10 is formed such that the first seal member 8 and the second seal member 9 are integrally connected to each other.

Figure 5:
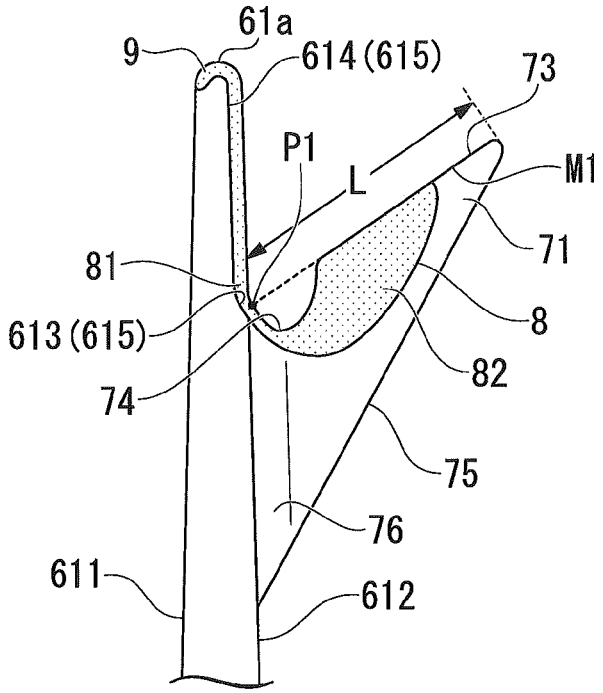
FIG. 5 is a main portion enlarged view when the tip end portion of the steam turbine rotor blade in the embodiment of the present invention is viewed from the radially inner side.

The first seal member 8 is provided so as to cover the leading edge-side transition region TA and at least a portion of the first surface 71. In the present embodiment, the first seal member 8 covers the entire region of the fourth surface 74, and covers a portion of the suction-side surface 612 connected to the fourth surface 74, a portion of the first surface 71 connected to the fourth surface 74, a portion of the third surface 73 connected to the fourth surface 74, and a portion of the connection surface 76. The first seal member 8 covers a boundary line M1 at which the third surface 73 and the first surface 71 of the protrusion portion 7 are connected to each other. As shown in FIG. 5, the first seal member 8 covers the boundary line M1 over a predetermined length from a connection point P1 between the boundary line M1 and the suction-side surface 612.

Here, the boundary line M1 is a side at which the first surface 71 and the third surface 73 which are flat surfaces are actually connected to each other in a case where these surfaces are directly connected to each other. Meanwhile, in a case where the first surface 71 and the third surface 73 are connected to each other via a curved surface, the boundary line M1 is an imaginary line which is formed when the first surface 71 and the third surface 73 are each extended. In addition, in a case where one or both of the first surface 71 and the third surface 73 is a curved surface, the boundary line M1 is an edge line at which the first surface 71 and the third surface 73 intersect each other when viewed from the inside in the radial direction.

In a case where a length of the boundary line M1 from the connection point P1 to the tip end portion of the protrusion portion 7 is defined as L, the predetermined length is a length of 0.9 L or less from the connection point P1.

In the present embodiment, the first seal member 8 includes a front-side seal portion 81 and a base end-side seal portion 82. In the first seal member 8, the front-side seal portion 81 and the base end-side seal portion 82 are integrally formed with each other.

The front-side seal portion 81 can be disposed in the first recessed portion 613 such that a surface of the front-side seal portion 81 is flush with the surface of the blade body 61. The front-side seal portion 81 covers only the leading edge-side transition region TA and the intersection region TC. In the present embodiment, the front-side seal portion 81 covers the entire region of the fourth surface 74 and covers a portion of the suction-side surface 612 connected to the fourth surface 74, a portion of the third surface 73 connected to the fourth surface 74, and a portion of the connection surface 76. Accordingly, in these regions, a continuous plane is formed such that the surface of the front-side seal portion 81 is positioned at the same position as (is flush with) the planes of the suction-side surface 612 and the protrusion portion 7.

Figure 6:
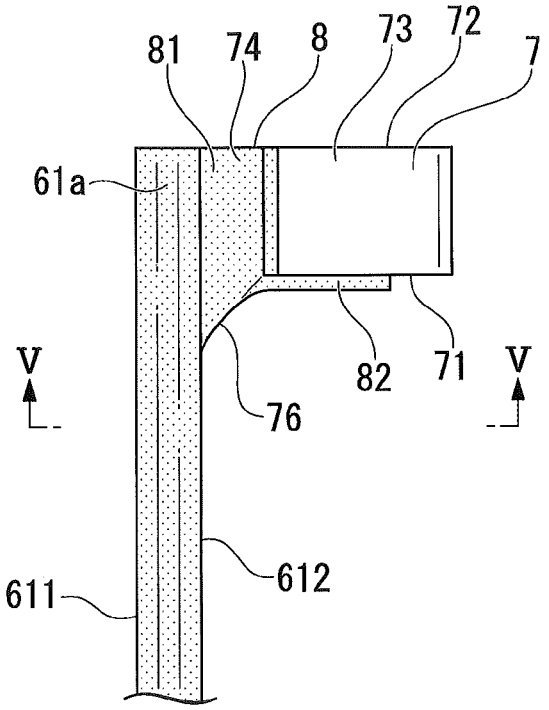
FIG. 6 is a main portion enlarged view when the tip end portion of the steam turbine rotor blade in the embodiment of the present invention is viewed from a leading edge portion side.

As shown in FIG. 6, the base end-side seal portion 82 can be disposed on the first surface 71 such that a surface of the base end-side seal portion 82 protrudes from the first surface 71. The base end-side seal portion 82 is integrally formed with the front-side seal portion 81 to be continuous with the front-side seal portion 81. The base end-side seal portion 82 covers only a portion of the first surface 71 that is connected to the fourth surface 74. In the present embodiment, the base end-side seal portion 82 does not cover the tip end portion of the first surface 71 on the leading edge portion 61*a* side, and a portion on the side close to the trailing edge portion 61*b* in the region connected to the connection surface 76. The base end-side seal portion 82 is formed so as to be placed on the first surface 71 with no gap. Accordingly, a step is formed at the end portion of the base end-side seal portion 82 on the first surface 71 with respect to the first surface 71. The base end-side seal portion 82 is formed to have a constant thickness.

As shown in FIGS. 3 and 4, the second seal member 9 is provided so as to cover the leading edge portion 61*a*. In the present embodiment, the second seal member 9 is provided at a portion of the leading edge portion 61*a* so as to cover a predetermined region of the leading edge portion 61*a* from the tip end in the blade height direction Dh. Here, for example, the predetermined region may be a portion of the leading edge portion 61*a* where an amount of adhering water droplets is large. The second seal member 9 is a plate-shaped member that is curved along the suction-side surface 612 and the pressure-side surface 611. The second seal member 9 is disposed in the second recessed portion 614. The second seal member 9 is formed such that a surface of the second seal member 9 is positioned at the same position as (is flush with) the pressure-side surface 611 and the suction-side surface 612. The second seal member 9 is formed to have the same thickness as the first seal member 8.

Figure 7:
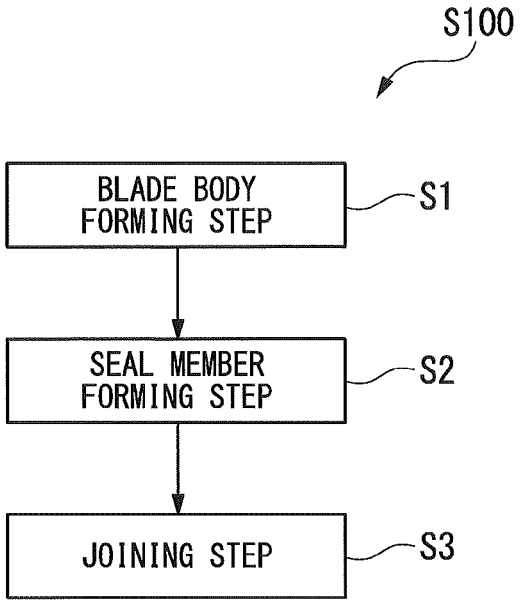
FIG. 7 is a flowchart showing a method for manufacturing a steam turbine rotor blade in an embodiment of the present invention.

Next, a method for manufacturing the rotor blade 6 (steam turbine rotor blade) described above will be described with reference to a flowchart shown in FIG. 7.

A method S100 for manufacturing the rotor blade of the present embodiment includes a blade body forming step S1, a seal member forming step S2, and a joining step S3.

In the method S100 for manufacturing the rotor blade, first, the blade body forming step S1 is performed. In the blade body forming step S1, the blade body 61 and the protrusion portion 7 of the rotor blade 6 are integrally formed with each other. For example, in the blade body forming step S1, the blade body 61 and the protrusion portion 7 are integrally formed with each other by casting. In the blade body forming step S1 of the present embodiment, the casting is performed using austenitic stainless steel. In the blade body forming step S1, the first recessed portion 613 which is recessed from the suction-side surface 612, the third surface 73, and the fourth surface 74 is formed in the leading edge-side transition region TA. In addition, in the blade body forming step S1, the second recessed portion 614 which is recessed from the pressure-side surface 611 and the suction-side surface 612 is formed at the leading edge portion 61*a*. In the blade body forming step S1 of the present embodiment, the dent portion 615 serving as the first recessed portion 613 and the second recessed portion 614 corresponding to the shape of the seal member 10 is formed in the blade body 61 such that the seal member 10 does not protrude from the surface of the blade body 61.

In the blade body forming step S1, the blade body 61 and the protrusion portion 7 may be formed by forming an intermediate product including the blade body 61 and the protrusion portion 7 and then providing the groove portion 70 by machining.

In the method S100 for manufacturing the rotor blade, secondly, the seal member forming step S2 is performed. In the seal member forming step S2 of the present embodiment, the first seal member 8 and the second seal member 9 are formed as the integral seal member 10. In the seal member forming step S2, the seal member 10 is formed by metal injection molding (MIM). In the seal member forming step S2, the seal member 10 is formed such that the front-side seal portion 81, the base end-side seal portion 82, and the second seal member 9 are integrated with each other.

In the method S100 for manufacturing the rotor blade, thirdly, the joining step S3 is performed. In the joining step S3, the seal member 10 is joined to the blade body 61. In the joining step S3, the seal member 10 is joined to the leading edge-side transition region TA and at least a portion of the first surface 71. In the joining step S3, the seal member 10 is joined to the dent portion 615 such that the seal member 10 does not protrude from the surface of the blade body 61. In this case, the seal member 10 is joined to the dent portion 615 with no gap such that the surfaces of the second seal member 9 and the front-side seal portion 81 are positioned at the same position as the planes of the suction-side surface 612 and the protrusion portion 7. In addition, the seal member 10 is joined in a state where the base end-side seal portion 82 is on and in contact with the first surface 71 without a gap such that the surface of the base end-side seal portion 82 protrudes from the first surface 71. In the joining step S3, the seal member 10 is fixed to the blade body 61 and the protrusion portion 7 by brazing using a silver solder.

In the present embodiment, the rotor blade that includes the blade body 61, the protrusion portion 7, and the dent portion 615 and is in a state before the seal member 10 is attached is referred to as a blade.

In the above-described steam turbine 100, the rotor blade 6 is disposed in the flow path through which the steam S flows from the upstream side toward the downstream side in the axial direction Da. In the steam S, water droplets (drain) are generated according to a decrease in pressure of the steam S. Accordingly, the steam S flows through the flow path in a state of containing the water droplets.

A diameter of each of the water droplets increases as the pressure of an exhaust gas after passing through the rotor blades 6 increases. In addition, an amount of water droplets generated increases as a wetness of the steam S in the flow path increases. Accordingly, water droplets having such a particle diameter as to easily cause erosion are easily generated particularly in the vicinity of the final stage on the most downstream side. Specifically, a large amount of water droplets having a particle diameter of approximately 100 μm to 200 μm are generated in the vicinity of the final stage. In addition, particularly, most of the water droplets reaching the protrusion portion 7 in the final stage have a particle diameter of approximately 140 μm to 150 μm.

The water droplets influenced by a centrifugal force as the rotor blades 6 rotate at a high speed in the flow path pass through the adjacent stator vanes 2 on the upstream side, and thereafter, the water droplets flow from the upstream side toward the downstream side in the axial direction Da and from the inside toward the outside in the radial direction Dr. As a result, the steam S and the water droplets collide with the protrusion portion 7 of the tip end of the rotor blade 6, and thus, erosion occurs.

Particularly, in the rotor blade 6 which is increased in length and size by increasing the length of the blade body 61 in the blade height direction Dh, the speed of collision with the water droplets increases toward the tip end portion. Accordingly, influences of thinning due to the erosion in the tip end portion are greater than those in other portions. In addition, like the present embodiment, in the case where the protrusion portion 7 is provided on the tip end portion of the blade body 61, the influences of the thinning due to the erosion are greater in the base end-side transition region TB of the connection portion between the blade body 61 and the protrusion portion 7 facing the base end side.

Meanwhile, according to the rotor blade 6 manufactured by the above-described method S100 for manufacturing the rotor blade, the base end-side transition region TB can be covered with the first seal member 8. The first seal member 8 is formed of a material harder than that of the blade body 61, and thus, it is possible to improve the erosion resistance. Accordingly, even when the water droplets flowing from the inside in the radial direction Dr (the base end side in the blade height direction Dh) to the outside (the tip end side) collide with the base end-side transition region TB, it is possible to suppress the erosion in the base end-side transition region TB. As a result, it is possible to prevent a situation where the thinning due to the erosion in the connection portion between the protrusion portion 7 and the blade body 61 progresses and the protrusion portion 7 falls off from the blade body 61. Accordingly, for example, even in a case where, in terms of design, the protrusion portion 7 is thinned in order to decrease the centrifugal force of the protrusion portion 7 which increases as the length of the blade body 61 in the blade height direction Dh increases, and thus the strength of the connection portion between the blade body 61 and the protrusion portion 7 is low, it is possible to prevent the protrusion portion 7 from falling off from the blade body 61. Accordingly, it is possible to decrease the influences of the erosion on the tip end portion of the rotor blade 6 in which the protrusion portion 7 is provided.

In addition, the base end-side seal portion 82 is disposed in the state of being placed on the first surface 71 such that the surface of the base end-side seal portion 82 protrudes from the first surface 71. Accordingly, it is not necessary to form a recessed portion in the first surface 71 for disposing the first seal member 8 inside the first surface 71. Therefore, it is possible to suppress a cost or a time for processing the first surface 71 which extends at an angle largely different from that of the suction-side surface 612. Accordingly, it is possible to suppress the influences of the erosion on the tip end portion, on which the protrusion portion 7 is formed, by the first seal member 8 which is manufactured while suppressing the cost.

In addition, that it is not necessary to form a recessed portion for disposing the first seal member 8 in the first surface 71 of the protrusion portion 7 is advantageous in securing the strength of the protrusion portion 7 that comes into contact with other adjacent blades and receives a force. In addition, it is possible to dispose the erosion shield simply by forming the recessed portion corresponding to the front-side seal portion 81, even for a type of a blade having no erosion shield disposed thereon. Accordingly, it is possible to simply improve the erosion resistance of the existing blade on which the erosion shield is not mounted.

In addition, the tip end of the boundary line M1 is partially not covered, and thus, it is not necessary to form a first seal member corresponding to a narrow region of the tip end portion of the protrusion portion 7. In addition, the boundary line M1 is covered from the connection point P1, and thus, it is possible to reliably protect the portion in which the erosion easily occurs. Accordingly, it is possible to suppress the manufacturing cost of the seal member 10 having the first seal member 8 while suppressing the influences of the erosion.

In addition, the second seal member 9 covers the predetermined region from the tip end portion of the leading edge portion 61*a* in the blade height direction Dh. Accordingly, the erosion resistance can be improved particularly in the vicinity of the tip end portion of the leading edge portion 61*a* in the blade height direction Dh that collides with the water droplets, and thus, it is possible to suppress the erosion. Moreover, in the leading edge portion 61*a*, the second seal member 9 does not protrude from the pressure-side surface 611 or the suction-side surface 612, and thus, it is possible to prevent the flow of the steam in the flow path from being hindered. Accordingly, it is possible to suppress the influences of the erosion in the leading edge portion 61*a* without hindering the flow of the steam.

Moreover, according to the above-described steam turbine 100, the erosion in the rotor blade 6 can be suppressed, and it is possible to lengthen a lifespan of the rotor blade 6. Accordingly, a frequency of maintaining the rotor blade 6 can be decreased, and thus, it is possible to efficiently operate the steam turbine 100. In addition, it is possible to streamline the shape of the protrusion portion 7 of the rotor blade 6, and thus, the rotor blade 6 can be made long and large.

Next, a modification example of the rotor blade will be described with reference to FIGS. 8 and 9.

In the modification example, the same reference numerals are assigned to components similar to those of the embodiment, and detailed descriptions thereof are omitted. A rotor blade of this modification example is different from that of the embodiment in that the transition-region seal member and the leading-edge seal member are separate members.

Figure 8:
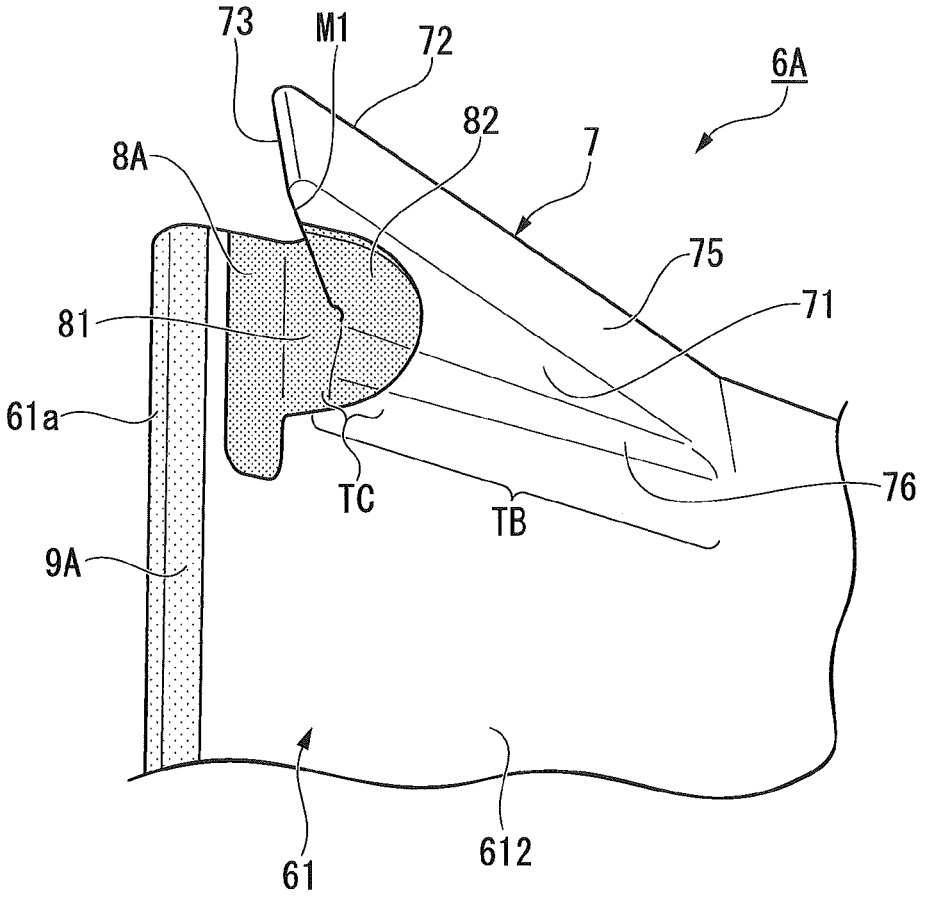
FIG. 8 is a perspective view showing a tip end portion of a steam turbine rotor blade in a modification example of the present invention from the radially inner side.
Figure 9:
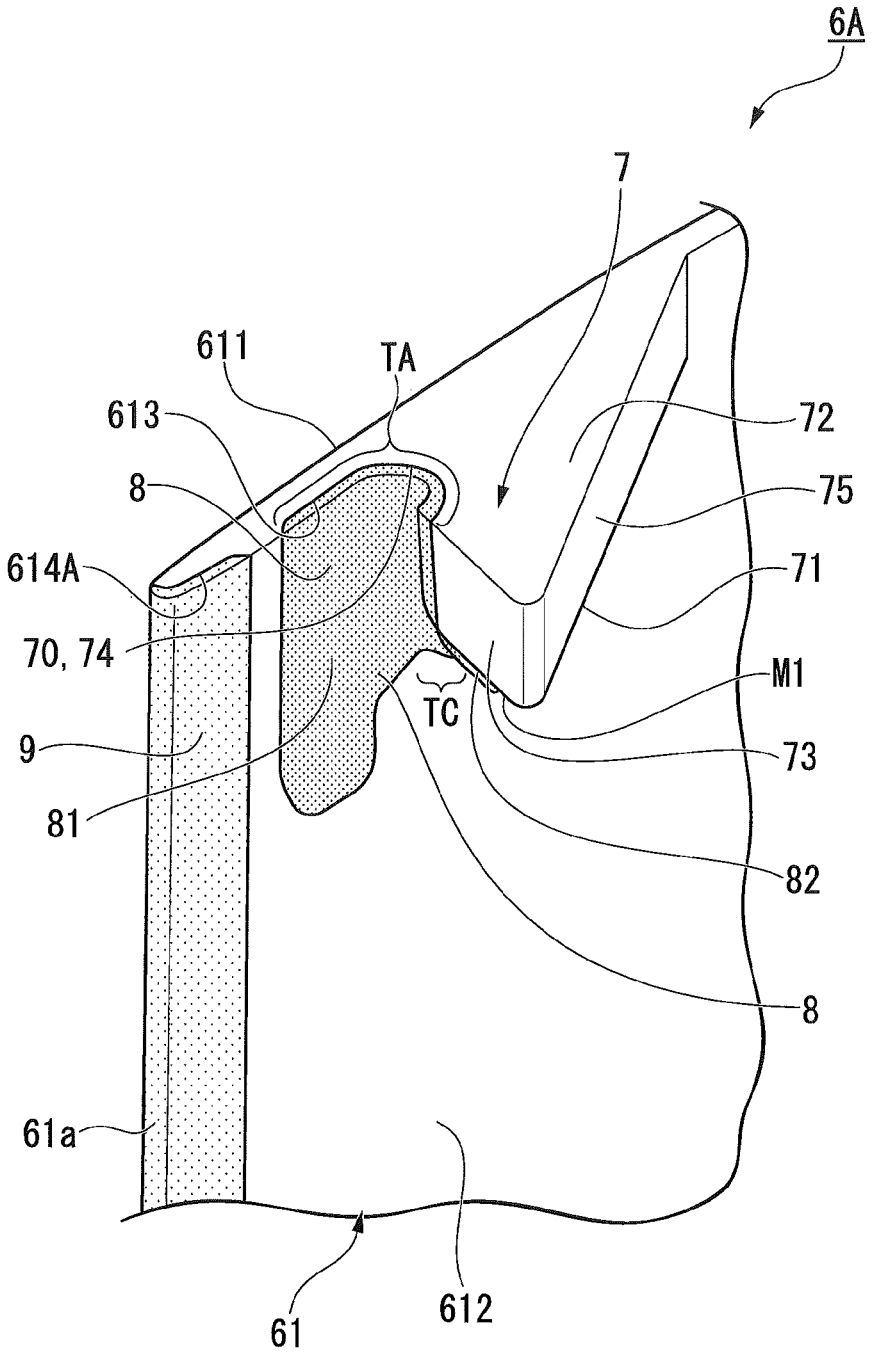
FIG. 9 is a perspective view showing the tip end portion of the steam turbine rotor blade in the modification example of the present invention from the radially outer side.

As shown in FIGS. 8 and 9, in a rotor blade 6A of the modification example, a first seal member 8A and a second seal member 9A are formed as separate members. The first seal member 8A and the second seal member 9A are disposed to be separated from each other. In this case, a first recessed portion 613A and a second recessed portion 614A are disposed to be separated from each other. The first seal member 8A is disposed in the first recessed portion 613A. The second seal member 9A is disposed in the second recessed portion 614A. Even with this configuration, the first seal member 8A that covers the protrusion portion 7 can be formed at a low cost.

Hereinbefore, the embodiments of the present invention have been described in detail with reference to the drawings. However, the configurations and combinations thereof in the respective embodiments are merely examples, and additions, omissions, substitutions, and other modifications of configurations are possible within the scope which does not depart from the gist of the present invention. In addition, the present invention is not limited by the embodiments but limited by only the claims.

For example, the rotor blades 6 and 6A having the protrusion portion 7 may be adopted to only those of the plurality of rotor blades aligned in the axial direction Da that compose a rotor blade row on the downstream side.

Moreover, in the present embodiment, the first seal member 8 or the seal member 10 is provided so as to cover the fourth surface 74 and a portion of the suction-side surface 612 continuous to the fourth surface 74 as the leading edge-side transition region TA. However, the present invention is not limited to this. For example, the first seal member 8 may be shaped so as not to cover a portion of the suction-side surface 612 continuous to the fourth surface 74 but to cover only the fourth surface 74 as the leading edge-side transition region TA. In addition, the first seal member 8 or the seal member 10 may be shaped so as to further cover the third surface 73 continuous to the fourth surface 74 as the leading edge-side transition region TA.

In addition, the present invention is not limited to the case where the second seal member 9 or the seal member 10 is provided on only a portion of the leading edge portion 61*a*. That is, the second seal member 9 or the seal member 10 may be provided over the entire region of the leading edge portion 61*a* in the blade height direction Dh.

Moreover, in the present embodiment, the protrusion portion 7 has the groove portion 70. However, the present invention is not limited to this shape. For example, the protrusion portion 7 may not have the groove portion 70, and the third surface 73 may be directly connected to the suction-side surface 612. In the case of this configuration, for example, the leading edge-side transition region TA is the third surface 73 and a portion of the suction-side surface 612 continuous to the third surface 73. In addition, for example, the intersection region TC is a region having a point at which the first surface 71, the third surface 73, and a portion of the suction-side surface 612 continuous to the third surface 73 intersect each other, as a center.

In addition, in the seal member forming step S2, the first seal member 8 or the second seal member 9 may be formed by precision casting or machining.

INDUSTRIAL APPLICABILITY

According to the steam turbine rotor blade, the steam turbine, and the method for manufacturing a steam turbine rotor bade described above, it is possible to suppress influences of erosion on the tip end portion on which the protrusion portion is formed.

REFERENCE SIGNS LIST

100: steam turbine
S: steam
Ac: axis
Da: axial direction
Dc: circumferential direction
Dr: radial direction
1: casing
11: steam inlet
12: steam outlet
2: stator vane
3: rotor
5: rotor body
6, 6A: rotor blade
Dh: blade height direction

61: blade body
611: pressure-side surface
612: suction-side surface
613, 613A: first recessed portion
614, 614A: second recessed portion
615: dent portion
61*a*: leading edge portion
61*b*: trailing edge portion
62: platform
63: blade root portion
7: protrusion portion
70: groove portion
71: first surface
72: second surface
73: third surface
74: fourth surface
75: fifth surface
76: connection surface
TA: leading edge-side transition region
TB: base end-side transition region
TC: intersection region
8, 8A: first seal member
81: front-side seal portion
82: base end-side seal portion
9, 9A: second seal member
10: seal member
4: bearing portion
41: journal bearing
42: thrust bearing
S100: method for manufacturing rotor blade
S1: blade body forming step
S2: seal member forming step
S3: joining step

What is claimed is:

1. A steam turbine rotor blade comprising:

a blade body which includes a pressure-side surface and a suction-side surface extending in a blade height direction and a leading edge portion which is formed by the pressure-side surface and the suction-side surface and extends in the blade height direction;

a protrusion portion which is provided on a tip end portion of the blade body in the blade height direction and protrudes from the suction-side surface toward a leading edge portion side; and a transition-region seal member which is provided so as to cover at least a portion of a base end-side surface of the protrusion portion facing a base end side opposite to a tip end in the blade height direction, and a leading edge-side transition region, facing the leading edge portion side, of a connection portion between the protrusion portion and the suction-side surface, the transition-region seal member being formed of a material having a hardness higher than that of the blade body, wherein a first recessed portion which is recessed from the suction-side surface is formed in the leading edge-side transition region, and wherein the transition-region seal member includes a front-side seal portion which is disposed in the first recessed portion such that a surface of the front-side seal portion is flush with a surface of the blade body, and a base end-side seal portion which is integrally formed with the front-side seal portion and is disposed on the base end-side surface such that a surface of the base end-side seal portion protrudes from the base end-side surface and the base end-side seal portion forms a step with the base end-side surface.

2. The steam turbine rotor blade according to claim 1, wherein the transition-region seal member covers a boundary line at which a leading edge-side surface of the protrusion portion facing a leading edge side and the base end-side surface of the protrusion portion are connected to each other, over a predetermined length from a connection point between the boundary line and the suction-side surface, and wherein in a case where a length of the boundary line from the connection point to a tip end portion of the protrusion portion is defined as L, the predetermined length is a length of 0.9 L or less from the connection point.

3. The steam turbine rotor blade according to claim 1, further comprising a leading-edge seal member which is provided so as to cover the leading edge portion and is formed of a material having a hardness higher than that of the blade body, wherein the blade body includes a second recessed portion which is recessed from the surface of the blade body at the leading edge portion, and wherein the leading-edge seal member is disposed in the second recessed portion such that a surface of the leading-edge seal member is flush with the surface of the blade body.

4. The steam turbine rotor blade according to claim 3, wherein the transition-region seal member and the leading-edge seal member are integrally formed with each other, and wherein the first recessed portion and the second recessed portion are formed to be connected to each other and to have the same depth.

5. A steam turbine comprising:

a rotor which includes the steam turbine rotor blade according to claim 1; and a casing which covers the rotor.

6. A method for manufacturing a steam turbine rotor blade, comprising:

a blade body forming step of integrally forming a blade body which includes a pressure-side surface and a suction-side surface extending in a blade height direction and a leading edge portion which is formed by the pressure-side surface and the suction-side surface and extends in the blade height direction, and a protrusion portion which is provided on a tip end portion of the blade body in the blade height direction and protrudes from the suction-side surface toward a leading edge portion side;

a seal member forming step of forming, by metal injection molding, a transition-region seal member which is shaped so as to cover at least a portion of a base end-side surface of the protrusion portion facing a base end side opposite to a tip end in the blade height direction, and a leading edge-side transition region, facing the leading edge portion side, of a connection portion between the protrusion portion and the suction-side surface, the transition-region seal member being formed of a material having a hardness higher than that of the blade body; and a joining step of joining the transition-region seal member to at least the leading edge-side transition region, wherein in the blade body forming step, a first recessed portion which is recessed from the suction-side surface is formed in the leading edge-side transition region, wherein the transition-region seal member includes a front-side seal portion which is capable of being disposed in the first recessed portion such that a surface of the front-side seal portion is flush with a surface of the blade body, and a base end-side seal portion which is integrally formed with the front-side seal portion and is capable of being disposed on the base end-side surface and the base end-side seal portion forms a step with the base end-side surface such that a surface of the base end-side seal portion protrudes from the base end-side surface, and wherein in the joining step, the transition-region seal member is joined to at least a portion of the base end-side surface and the leading edge-side transition region.

7. The method for manufacturing a steam turbine rotor blade according to claim 6, wherein in the joining step, the transition-region seal member is brazed to the blade body and the protrusion portion.

* * * * *